US012114770B2

(12) United States Patent
Chu

(10) Patent No.: US 12,114,770 B2
(45) Date of Patent: Oct. 15, 2024

(54) FOLDABLE HEIGHT ADJUSTABLE TABLE STAND

(71) Applicants: Shih-Ting Chu, Dongguan (CN); TIMOTION TECHNOLOGY CO., LTD., New Taipei (TW)

(72) Inventor: Shih-Ting Chu, Dongguan (CN)

(73) Assignees: Shih-Ting Chu, Dongguan (CN); TIMOTION TECHNOLOGY CO., LTD., New Taipei (TW)

( * ) Notice: Subject to any disclaimer, the term of this patent is extended or adjusted under 35 U.S.C. 154(b) by 69 days.

(21) Appl. No.: 18/105,804

(22) Filed: Feb. 4, 2023

(65) Prior Publication Data

US 2024/0090659 A1 Mar. 21, 2024

(30) Foreign Application Priority Data

Sep. 19, 2022 (CN) ..... 202222483893.2

(51) Int. Cl.

| | |
|---|---|
| ***A47B 3/08*** | (2006.01) |
| ***A47B 9/16*** | (2006.01) |
| *A47B 13/02* | (2006.01) |

(52) U.S. Cl.

CPC ..... *A47B 3/08* (2013.01); *A47B 9/16* (2013.01); *A47B 2003/0824* (2013.01); *A47B 13/02* (2013.01); *A47B 2200/0057* (2013.01)

(58) Field of Classification Search

CPC ..... A47B 9/00; A47B 9/04; A47B 2009/043; A47B 2009/046; A47B 3/08; A47B 2003/0824; A47B 2200/0057

See application file for complete search history.

(56) References Cited

U.S. PATENT DOCUMENTS 4,615,279 A * 10/1986 de la Haye ..... A47B 9/04 108/65
9,848,696 B2 * 12/2017 Tseng ..... A47B 9/04
(Continued)

FOREIGN PATENT DOCUMENTS

| | | |
|---|---|---|
| CN | 103126303 A | 6/2013 |
| TW | M586563 U | 11/2019 |
| TW | M637825 U | 2/2023 |

OTHER PUBLICATIONS

Office Action dated Jun. 20, 2023 of the corresponding Taiwan patent application No. 111144822.

*Primary Examiner* — Janet M Wilkens
*Assistant Examiner* — Timothy M Ayres
(74) *Attorney, Agent, or Firm* — Chun-Ming Shih; HDLS IPR SERVICES

(57) ABSTRACT

A table stand includes a first pivoting stabilizer, a second pivoting stabilizer, a first height adjustable pole connected to the first pivoting stabilizer, a second height adjustable pole connected to the second pivoting stabilizer, a folding transmission mechanism separately connected to the first height adjustable pole and the second height adjustable pole, and a support crossbar connected to the folding transmission mechanism. The first pivoting stabilizer and the second pivoting stabilizer are movably connected to two ends of the support crossbar. Each of the first pivoting stabilizer and the second pivoting stabilizer includes a first blocking edge, a second blocking edge, and a first shaft sequentially passing through the first blocking edge and the second blocking edge. The support crossbar is disposed between the first blocking edge and the second blocking edge.

10 Claims, 7 Drawing Sheets

(56) References Cited

U.S. PATENT DOCUMENTS

| | | | | |
|---|---|---|---|---|
| 10,349,737 | B2 * | 7/2019 | Keller | A47B 3/0812 |
| 10,568,418 | B2 * | 2/2020 | Applegate | A47B 3/12 |
| 10,842,258 | B2 * | 11/2020 | Applegate | A47B 13/02 |
| 11,382,414 | B1 * | 7/2022 | Zhang | A47B 3/0818 |
| 11,490,726 | B1 * | 11/2022 | Zhang | A47B 13/06 |
| 11,596,221 | B2 * | 3/2023 | Lin | A47B 9/04 |
| 11,696,637 | B2 * | 7/2023 | Lin | A47B 9/04 108/144.11 |
| 2021/0015250 | A1 * | 1/2021 | Chu | A47B 17/02 |
| 2021/0100356 | A1 * | 4/2021 | Huang | A47B 17/03 |
| 2023/0270246 | A1 * | 8/2023 | Lin | A47B 9/04 108/50.02 |
| 2023/0363526 | A1 * | 11/2023 | Li | A47B 3/08 |

* cited by examiner

FOLDABLE HEIGHT ADJUSTABLE TABLE STAND

BACKGROUND

Technical Field

The disclosure relates to a height adjustable table technology, particularly to a foldable height adjustable table stand.

Related Art

Tables are indispensable household and office items. The height of traditional tables is fixed and cannot be adjusted according to a user's personal situation and actual needs. The comfort level is low, and long-time usage with the traditional table may cause damage to the spine, waist and back, or other diseases. A height-adjustable desk can be adjusted in height according to a user's different body shape and height, etc., to improve comfort level and relieve pain.

Related art shows a foldable height adjustable table stand, which includes two support frames arranged adjustably, a crossbar and a linked rod disposed on the support frames. The linked rod is provided with a movable joint connected to the support frame. The crossbar is connected with a support cover connected with the support frame. The crossbar is disposed with a movable bolt which is movably installed on a side of the support cover. A side of the support frame is disposed with a fixed bolt. The crossbar is formed with a folding trough corresponding to the fixed bolt. Its drawback is that the support cover is of a half-covering shape and is connected to the crossbar with two sides, it is easy to cause vibration to result in structural instability. Also, the half-covering structure reduces the using strength to be disadvantageous for usage.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

To accomplish the above technological problem, the disclosure provides a foldable height adjustable table stand with great stability and high using strength.

The foldable height adjustable table stand of the disclosure includes a first pivoting stabilizer, a second pivoting stabilizer, a first height adjustable pole, a second height adjustable pole, a folding transmission mechanism and a support crossbar. The first height adjustable pole is connected to the first pivoting stabilizer. The second height adjustable pole is connected to the second pivoting stabilizer. The folding transmission mechanism is connected to the first height adjustable pole and the second height adjustable pole. The support crossbar is connected to the folding transmission mechanism. The first pivoting stabilizer and the second pivoting stabilizer are movably connected to two ends of the support crossbar separately. Each of the first pivoting stabilizer and the second pivoting stabilizer includes a first blocking edge, a second blocking edge and a first shaft. The second blocking edge is arranged parallelly with the first blocking edge. The support crossbar is disposed between the first blocking edge and the second blocking edge. The first shaft passes through the first blocking edge, the support crossbar and the second blocking edge in order.

In an embodiment, the folding transmission mechanism includes a transmission rod, a driving motor connected to the transmission rod, and a first connecting rod and a second connecting rod movably connected with two ends of the transmission rod separately, one end of the transmission rod is connected to the first connecting rod through a movable joint, and another end of the transmission rod is connected to the second connecting rod through another movable joint.

In an embodiment, the movable joint includes two connectors and a second shaft movably connected with the two connectors, a central axis line of the second shaft and a central axis line of the first shaft are parallel or coinciding to each other.

In an embodiment, the first connecting rod is movably connected to the first height adjustable pole, and the second connecting rod is movably connected to the second height adjustable pole.

In an embodiment, an end of the first blocking edge further includes a first extending sheet, and an end of the second blocking edge further includes a second extending sheet.

In an embodiment, the first shaft passes through the first extending sheet, and the support crossbar and the second extending sheet in order.

In an embodiment, each of the first pivoting stabilizer and the second pivoting stabilizer includes a receiving portion perpendicularly connected with the first extending sheet and the second extending sheet separately, and a restraint trough is defined among the receiving portion, the first extending sheet and the second extending sheet to stop the support crossbar.

In an embodiment, the receiving portion is provided with multiple connecting holes.

In an embodiment, a cross-section of each of the first pivoting stabilizer and the second pivoting stabilizer is a U-shaped structure.

In an embodiment, a side of the first blocking edge is outward extended to be connected to an installing plate with an installing hole, and a side of the second blocking edge is formed with an arcuate trough.

The advantage of the disclosure is that each pivoting stabilizer has a U-shaped cross-section to contact the support crossbar with three surfaces to avoid shake, and improve the overall stability and enhance the using strength of the foldable height adjustable table stand.

DETAILED DESCRIPTION

Figure 1:
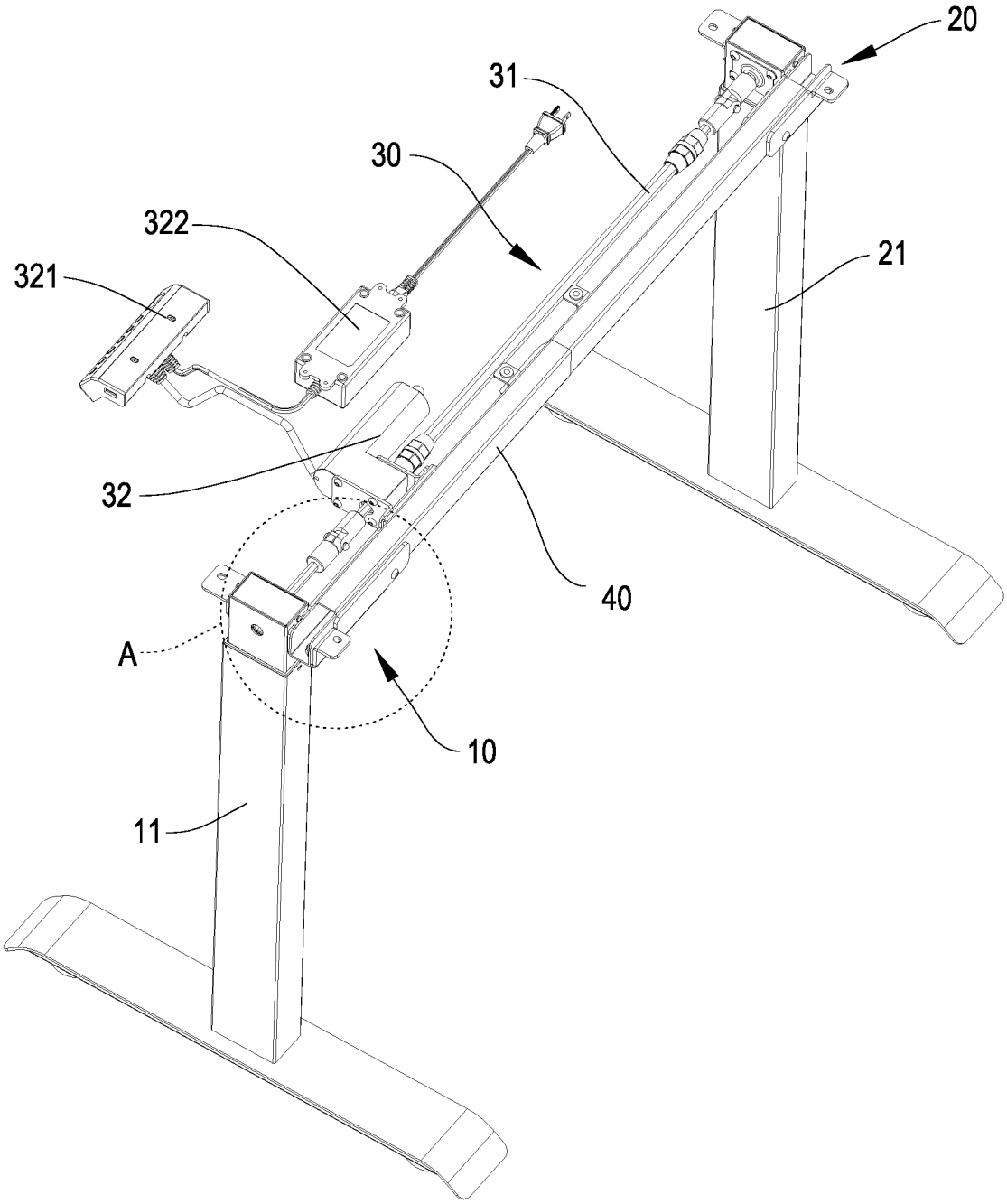
FIG. 1 is a structural schematic view of the foldable height adjustable table stand of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

In the description of the disclosure, as used herein, words such as "central", "inner" and "outer," "interior" and "exterior," "upper" and "lower," "outside" and "inside," "top" and "bottom," "left" and "right," "vertical" and "horizontal" and words of similar import are intended to assist in understanding embodiments of the disclosure with reference to the accompanying drawings with respect to the orientation as shown in the figures, and are not intended to be limiting to the scope of the disclosure or to limit the disclosure scope to the embodiments shown in the figures. In addition, the terms "first", "second" and "third" are used for descriptive object only, should not be understood to be as expressing or implying relative importance.

In the description of the disclosure, it is noted that phrases "install", "link" and "connect" should be broadly understood, for example, they may be fixed connection, detachable connection or integrated connection; may be mechanic connection or electric connection; may be direct linkage or indirect linkage through an intermediate, may be interior communication between two elements. Further, words in the claims and specification hereof are intended to have their ordinary meaning to one skilled in the art as amplified or clarified by any further application-specific information, in the absence of an express, applicant-provided definition.

Please refer to FIGS. 1-7. A foldable height adjustable table stand includes a first pivoting stabilizer 10, a second pivoting stabilizer 20, a first height adjustable pole 11 connected to the first pivoting stabilizer 10, a second height adjustable pole 21 connected to the second pivoting stabilizer 20, a folding transmission mechanism 30 separately connected to the first height adjustable pole 11 and the second height adjustable pole 21, and a support crossbar 40 connected to the folding transmission mechanism 30. The first pivoting stabilizer and the second pivoting stabilizer 20 are movably connected to two ends of the support crossbar 40 separately. Each of the first pivoting stabilizer 10 and the second pivoting stabilizer 20 includes a first blocking edge 50, a second blocking edge 60 and a first shaft 70. The second blocking edge 60 is arranged to be parallel to the first blocking edge 50. The first shaft 70 passes through the first blocking edge 50 and the second blocking edge 60 in order. The support crossbar 40 is disposed between the first blocking edge 50 and the second blocking edge 60.

In an embodiment, the first pivoting stabilizer 10 has the same structure as the second pivoting stabilizer 20. Each pivoting stabilizer 10, 20 has a U-shaped cross-section to contact the support crossbar 40 with three surfaces to avoid shake, and improve the overall stability and enhance the using strength of the foldable height adjustable table stand.

As shown in FIG. 1, the folding transmission mechanism 30 includes a transmission rod 31, a driving motor 32 connected to the transmission rod 31, and a first connecting rod 33 and a second connecting rod 34 movably connected with two ends of the transmission rod 31 separately. An end of the transmission rod 31 is connected to the first connecting rod 33 through a movable joint 90. An end of the transmission rod 31, which is opposite to the first connecting rod 33, is connected to the second connecting rod 34 through another movable joint 90. The first connecting rod 33 is movably connected to the first height adjustable pole 11 and the second connecting rod 34 is movably connected to the second height adjustable pole 21. The driving motor 32 is connected with a control board 321, and the control board 321 is connected to a power supply 322.

When operating, the driving motor 32 drives the transmission rod 31 to rotate, the transmission rod 31 separately drives the first connecting rod 33 and the second connecting rod 34 to rotate, the gears (not shown in figures) of the first connecting rod 33 and the second connecting rod 34 are separately engaged with the gears (not shown in figures) of the lead screws of the first height adjustable pole 11 and the second height adjustable pole 21 to drive the lead screws of the first height adjustable pole 11 and the second height adjustable pole 21 to implement electric ascending or descending.

Figure 4:
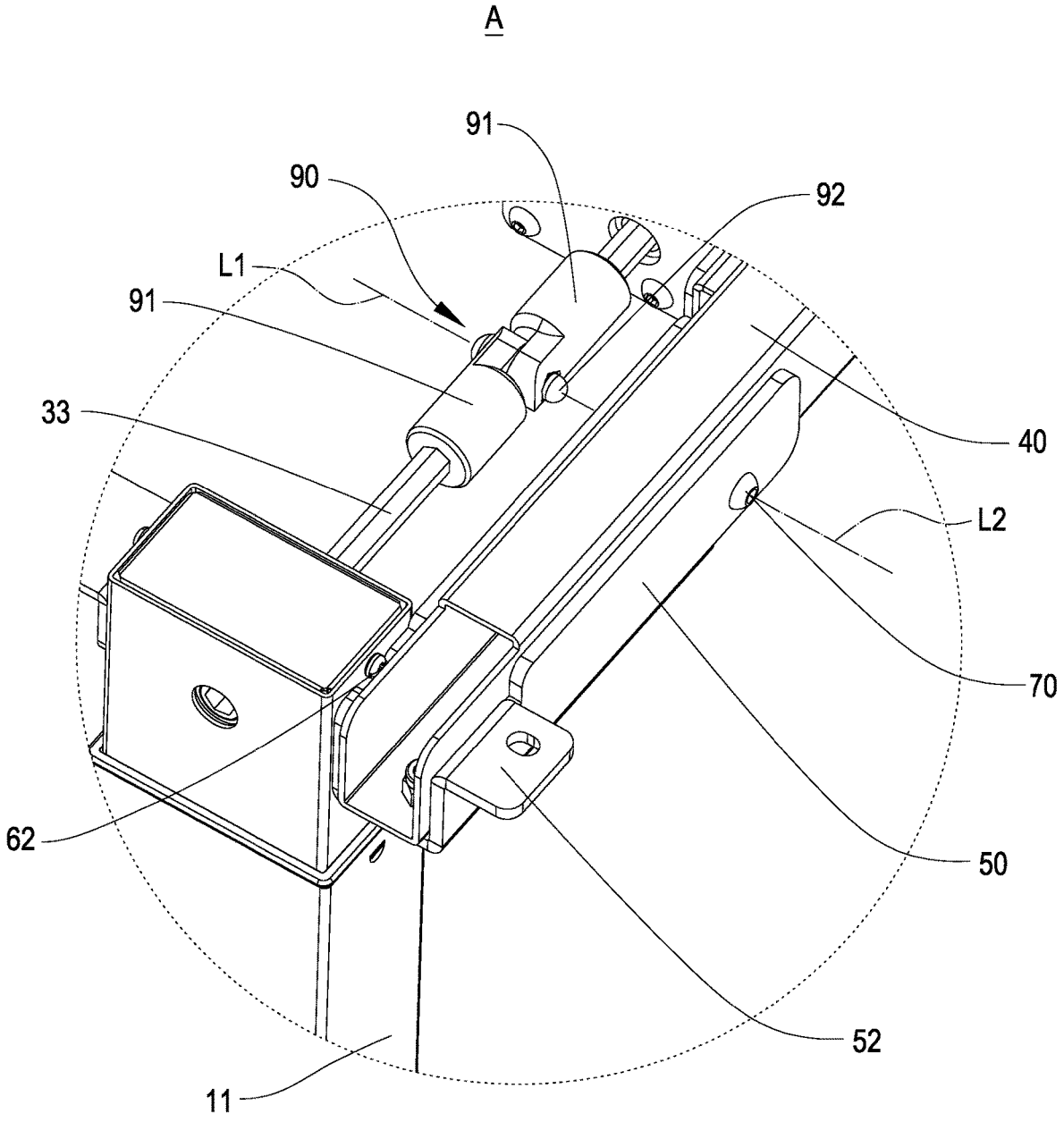
FIG. 4 is a partially enlarged view of area A of the foldable height adjustable table stand in FIG. 1 of the disclosure.
Figure 5:
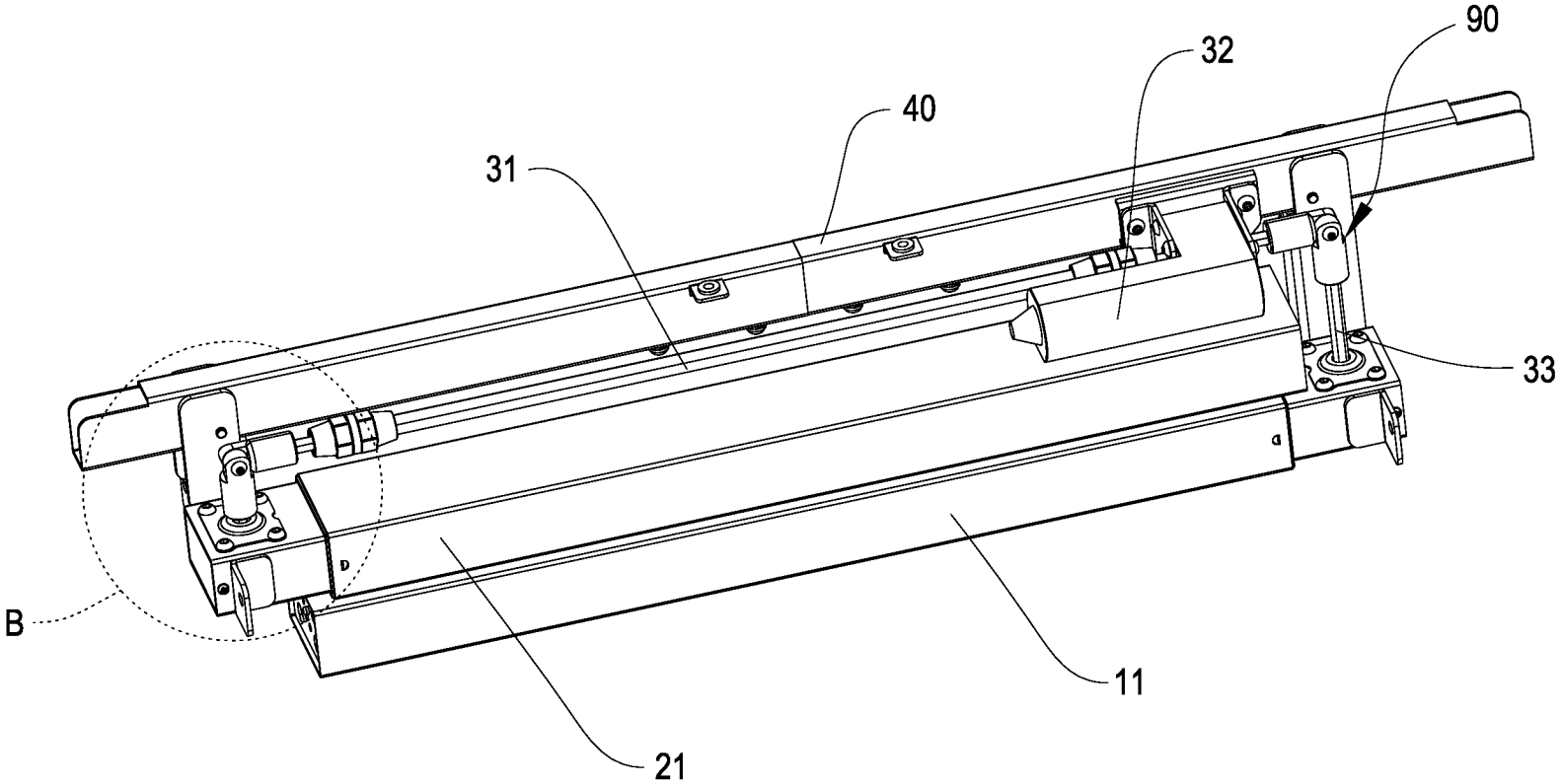
FIG. 5 is a schematic view of the foldable height adjustable table stand in FIG. 1 of the disclosure in a folded status.
Figure 6:
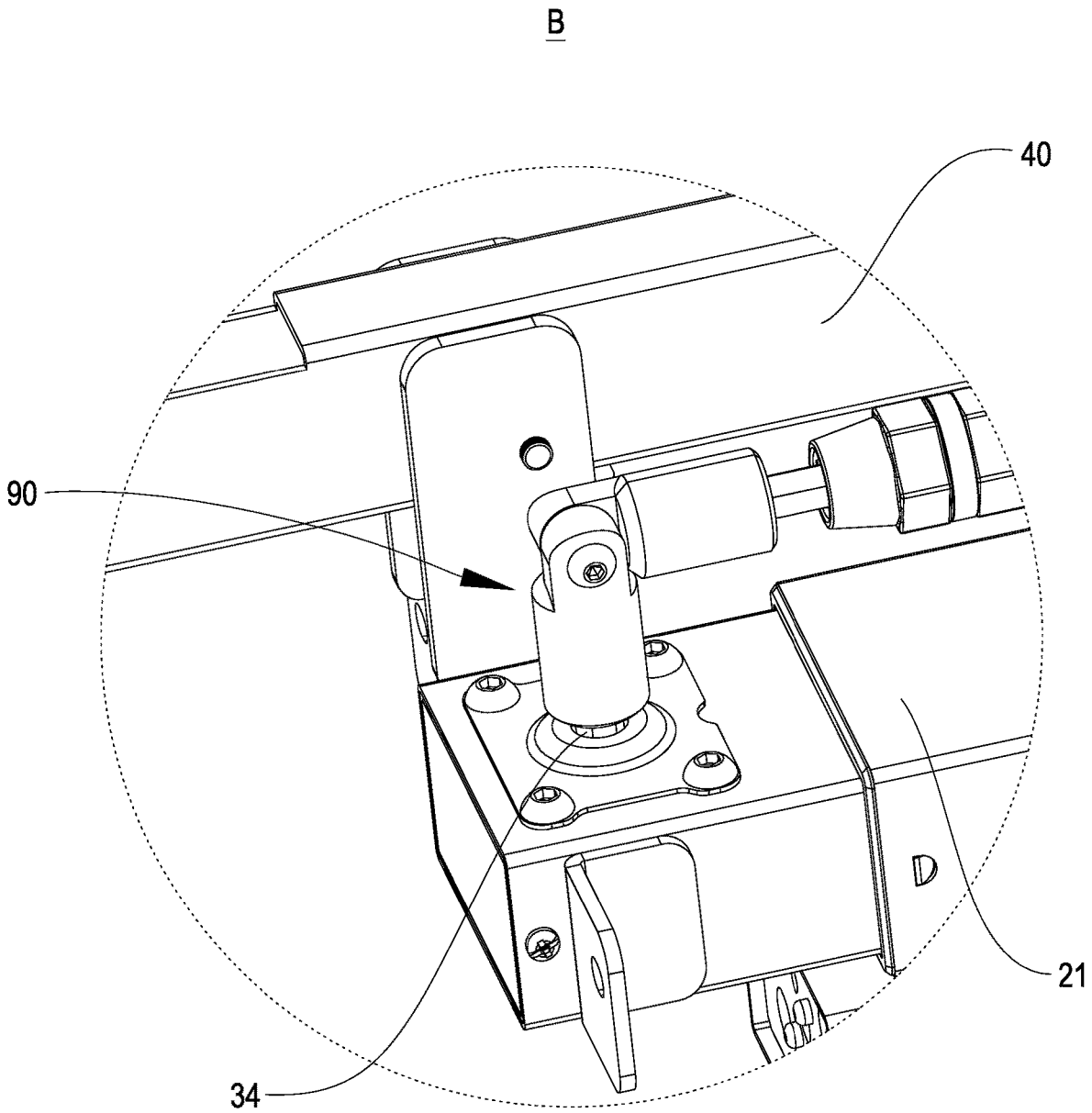
FIG. 6 is a partially enlarged view of area B of the foldable height adjustable table stand in FIG. 5 of the disclosure.
Figure 7:
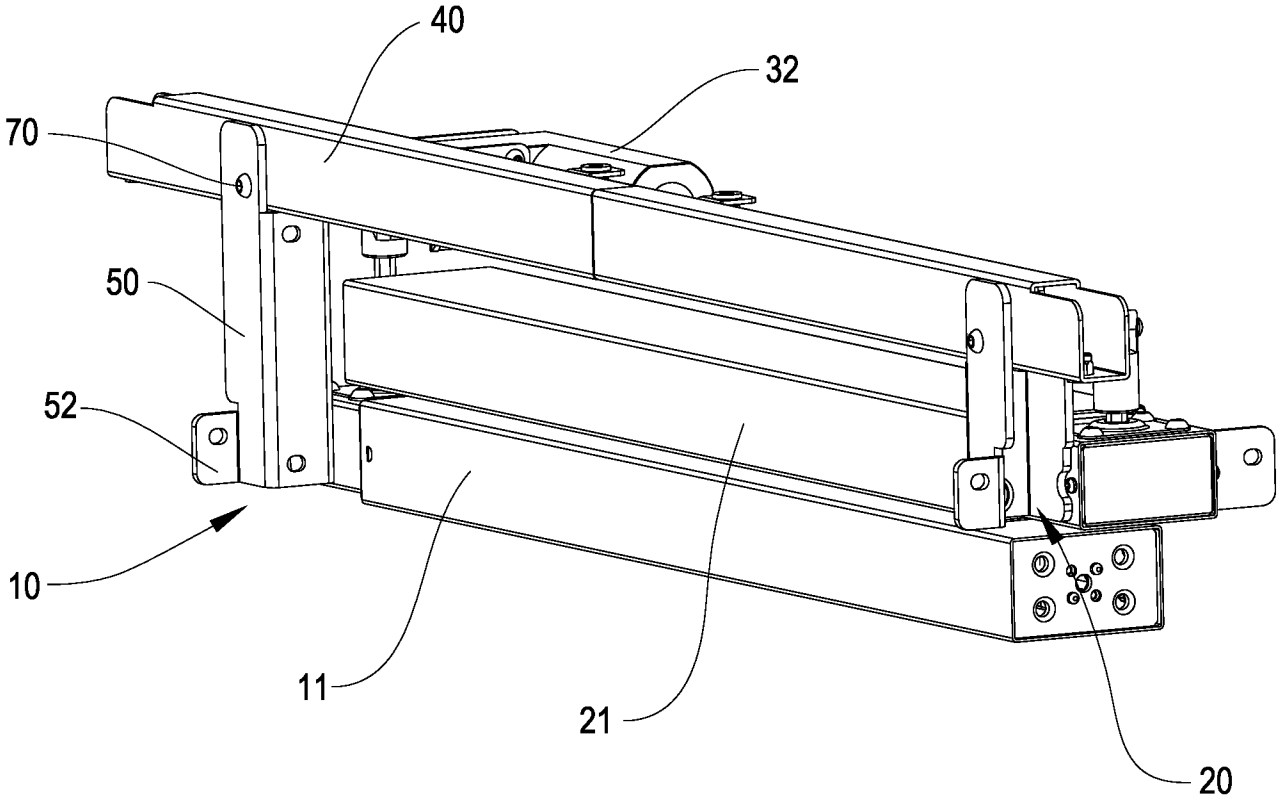
FIG. 7 is a schematic view of the foldable height adjustable table stand in FIG. 1 of the disclosure in a folded status from another viewpoint.

As shown in FIG. 4, in an embodiment, the movable joint 90 includes two connectors 91 and a second shaft 92 movably connected with the two connectors 91. A central axis line L1 of the second shaft 92 and a central axis line L2 of the first shaft 70 are configured to be parallel or coinciding to each other. With such an arrangement, two central axis lines of the two are configured to be parallel each other or coinciding (it means that the two central axis lines can coincide with a single straight line) to facilitate folding the pole. The practicality is desirable.

Figure 2:
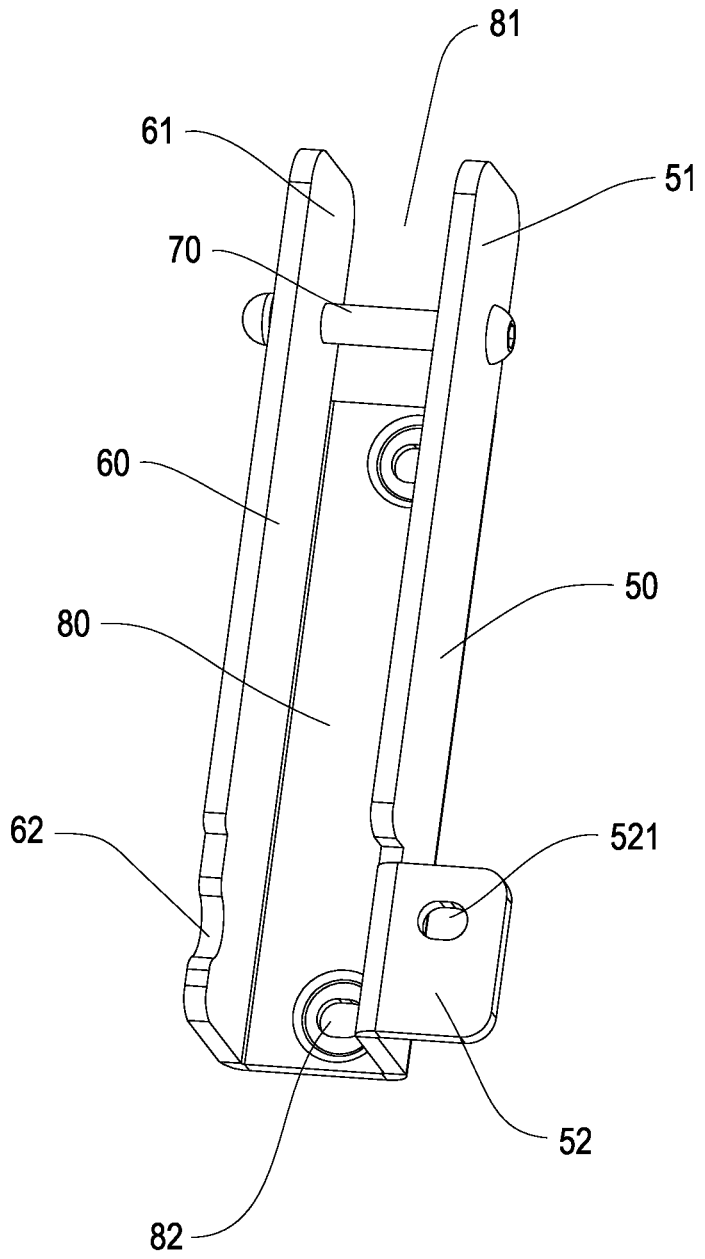
FIG. 2 is a structural schematic view of the first pivoting stabilizer of the foldable height adjustable table stand in FIG. 1.

As shown in FIG. 2, in an embodiment, an end of the first blocking edge 50 further includes a first extending sheet 51, and an end of the second blocking edge 60 further includes a second extending sheet 61. The first shaft 70 passes through the first extending sheet 51, the support crossbar 40 and the second extending sheet 61 in order. With such an arrangement, the first extending sheet 51 and the second extending sheet 61 are separately connected the support crossbar 40. Each first shaft 70 is used for each pivoting stabilizer 10, 20 to be rotatably disposed.

Figure 3:
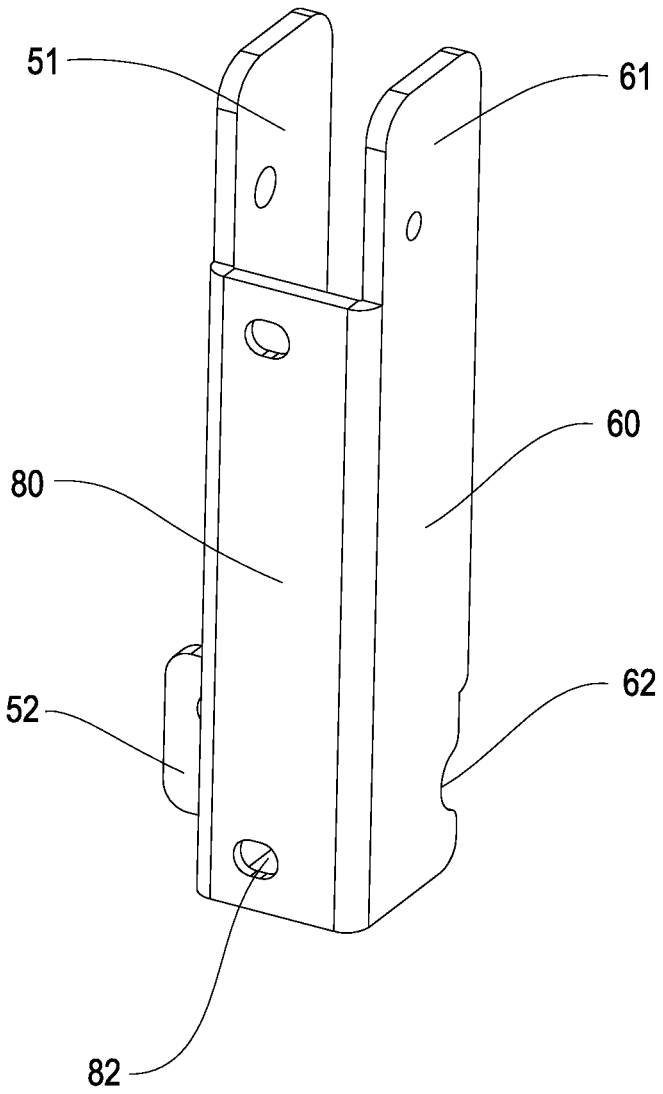
FIG. 3 is a structural schematic view of the first pivoting stabilizer of the foldable height adjustable table stand in FIG. 1 of the disclosure from another viewpoint.

As shown in FIGS. 2 and 3, in an embodiment, each of the first pivoting stabilizer 10 and the second pivoting stabilizer 20 includes a receiving portion 80 perpendicularly connected with the first extending sheet 51 and the second extending sheet 61 separately. The receiving portion 80, the first extending sheet 51, and the second extending sheet 61 form a restraint trough 81 for stopping or blocking the support crossbar 40. The restraint trough 81 may prevent each pivoting stabilizer 10, 20 from overly rotating to cause a dead point and affect the folding smoothness.

When a folding is needed, the first pivoting stabilizer 10 downward moves along the first shaft 70 first, and the first height adjustable pole 11 rotates therewith. The first folding is finished when the restraint trough 81 of the first pivoting stabilizer 10 touches the support crossbar 40. The second pivoting stabilizer 20 downward moves along the first shaft 70 first, and the second height adjustable pole 21 rotates therewith. The second folding is finished when the restraint trough 81 of the second pivoting stabilizer 20 touches the support crossbar 40.

As shown in FIGS. 2 and 3, in an embodiment, the receiving portion 80 is provided with multiple connecting holes 82, when installation is needed, they may be stably connected to the support crossbar 40 through screws in an amount the same with the connecting holes 82. The practicality is desirable. In an embodiment, the amount of the connecting holes 82 is two for easily to be connected with the support crossbar 40.

As shown in FIGS. 2 and 3, in an embodiment, a side of the first blocking edge 50 is outward extended to connect to an installing plate 52 with an installing hole 521. The installing plate 52 is advantageous for connecting with a table board. In an embodiment, a side of the second blocking edge 60 is formed with an arcuate trough 62 for avoiding installing screws of each height adjustable pole 11, 21 to provide convenience to the normal operation of folding.

While this disclosure has been described by means of specific embodiments, numerous modifications and variations could be made thereto by those skilled in the art without departing from the scope and spirit of this disclosure set forth in the claims.

What is claimed is:

1. A foldable height adjustable table stand comprising:

a first height adjustable pole;

a second height adjustable pole;

a first pivoting stabilizer, connected to a first surface of the first height adjustable pole;

a second pivoting stabilizer, connected to a first surface of the second height adjustable pole;

a folding transmission mechanism, with two ends thereof connected to a second surface of the first height adjustable pole and a second surface of the second height adjustable pole, respectively; and a support crossbar, connected to the folding transmission mechanism;

wherein the first pivoting stabilizer and the second pivoting stabilizer are movably connected to two ends of the support crossbar respectively, each of the first pivoting stabilizer and the second pivoting stabilizer comprises a first blocking edge, a second blocking edge and a first shaft, the second blocking edge is arranged parallelly with the first blocking edge, the support crossbar is disposed between the first blocking edge and the second blocking edge, and the first shaft sequentially passes through the first blocking edge, the support crossbar and the second blocking edge;

wherein the folding transmission mechanism is disposed between the first height adjustable pole and the second height adjustable pole, and the first height adjustable pole, the support crossbar and the second height adjustable pole are disposed aside the first height adjustable pole, the folding transmission mechanism and the second height adjustable pole.

2. The foldable height adjustable table stand of claim 1, wherein the folding transmission mechanism comprises a transmission rod, a driving motor connected to the transmission rod, and a first connecting rod and a second connecting rod movably connected with two ends of the transmission rod respectively, one end of the transmission rod is connected to the first connecting rod through a movable joint, and another end of the transmission rod is connected to the second connecting rod through another movable joint.

3. The foldable height adjustable table stand of claim 2, wherein the movable joint comprises two connectors and a second shaft movably connected with the two connectors, a central axis line (L1) of the second shaft and a central axis line (L2) of the first shaft are parallel or coinciding to each other.

4. The foldable height adjustable table stand of claim 2, wherein the first connecting rod is movably connected to the first height adjustable pole, and the second connecting rod is movably connected to the second height adjustable pole.

5. The foldable height adjustable table stand of claim 1, wherein the first blocking edge further comprises a first extending sheet disposed on an end thereof, and the second blocking edge further comprises a second extending sheet disposed on an end thereof.

6. The foldable height adjustable table stand of claim 5, wherein the first shaft sequentially passes through the first extending sheet, and the support crossbar and the second extending sheet.

7. The foldable height adjustable table stand of claim 5, wherein each of the first pivoting stabilizer and the second pivoting stabilizer comprises a receiving portion perpendicularly connected with the first extending sheet and the second extending sheet respectively, and a restraint trough is defined among the receiving portion, the first extending sheet and the second extending sheet to block the support crossbar.

8. The foldable height adjustable table stand of claim 7, wherein the receiving portion comprises multiple connecting holes.

9. The foldable height adjustable table stand of claim 1, wherein a cross-section of each of the first pivoting stabilizer and the second pivoting stabilizer is a U-shaped structure.

10. The foldable height adjustable table stand of claim 1, wherein the first blocking edge comprises an installing plate outward extended from a side thereof, the installing plate comprises an installing hole, and the second blocking edge comprises an arcuate trough defined on a side thereof.

* * * * *